US006710237B2

(12) United States Patent
Adams

(10) Patent No.: US 6,710,237 B2
(45) Date of Patent: Mar. 23, 2004

(54) DRUM PEDAL FOR ENHANCED MATING OF A DRUMMER'S FOOT

(76) Inventor: Steven P. Adams, 1100 Calle Cordillera, San Clemente, CA (US) 92673

( * ) Notice: Subject to any disclaimer, the term of this patent is extended or adjusted under 35 U.S.C. 154(b) by 123 days.

(21) Appl. No.: 10/078,126

(22) Filed: Feb. 19, 2002

(65) Prior Publication Data

US 2003/0154846 A1 Aug. 21, 2003

(51) Int. Cl.[7] ..... G10D 13/02
(52) U.S. Cl. ..... 84/422.1; 84/426
(58) Field of Search ..... 84/422.1, 422.3, 84/422.2, 426

(56) References Cited

U.S. PATENT DOCUMENTS 4,619,055 A * 10/1986 Davidson ..... 36/28
4,744,279 A * 5/1988 Livingston ..... 84/746
5,627,332 A * 5/1997 Lombardi ..... 84/422.1
5,996,253 A * 12/1999 Spector ..... 36/27
RE37,705 E * 5/2002 Donzis ..... 12/142 R

* cited by examiner

*Primary Examiner*—Kimberly Lockett
(74) *Attorney, Agent, or Firm*—Daniel L. Dawes; Myers Dawes Andras & Sherman LLP

(57) ABSTRACT

A drum pedal for enhanced mating of a drummer's foot is disclosed. In a preferred embodiment, a foot pad is employed for attachment to a pedal of a drum having an upwardly extending protrusion that enables improved sensory perception to properly locate a drummer's foot and to enable learning and consistently applying a force to a sweet spot during drumming. The foot pad also includes shock absorption to reduce the negative effects of repeated impact to the user's foot during drumming. A variety of embodiments include traction treads, a plurality of protrusions or built up portions in different respective locations of the footpad, and an additional stiffening layer to effectively widen the foot pedal. A method of use includes locating the foot pad on a the foot pedal, and in particular locating a protrusion on the foot pedal to enable consistent drumming by improved sensory perception and positioning of a drummer's foot during drumming.

29 Claims, 6 Drawing Sheets

FIG. 5A
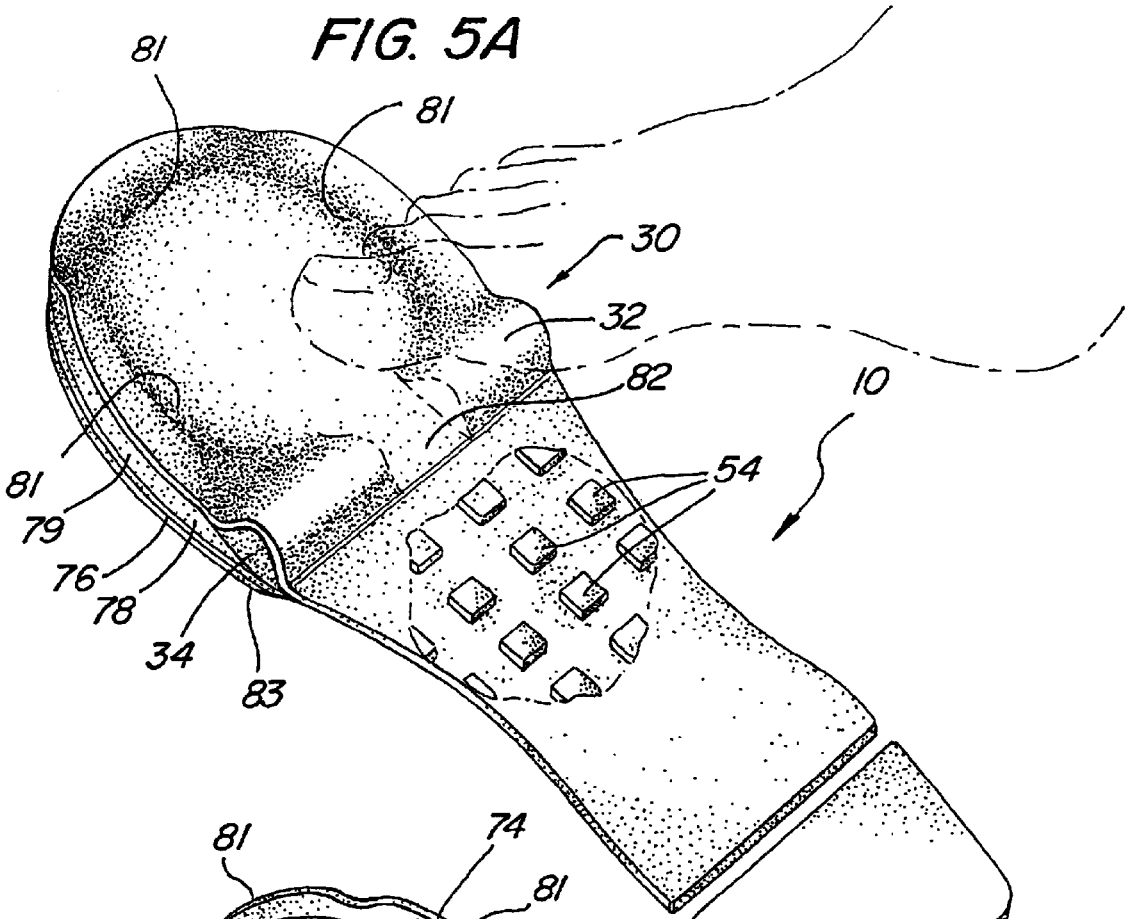
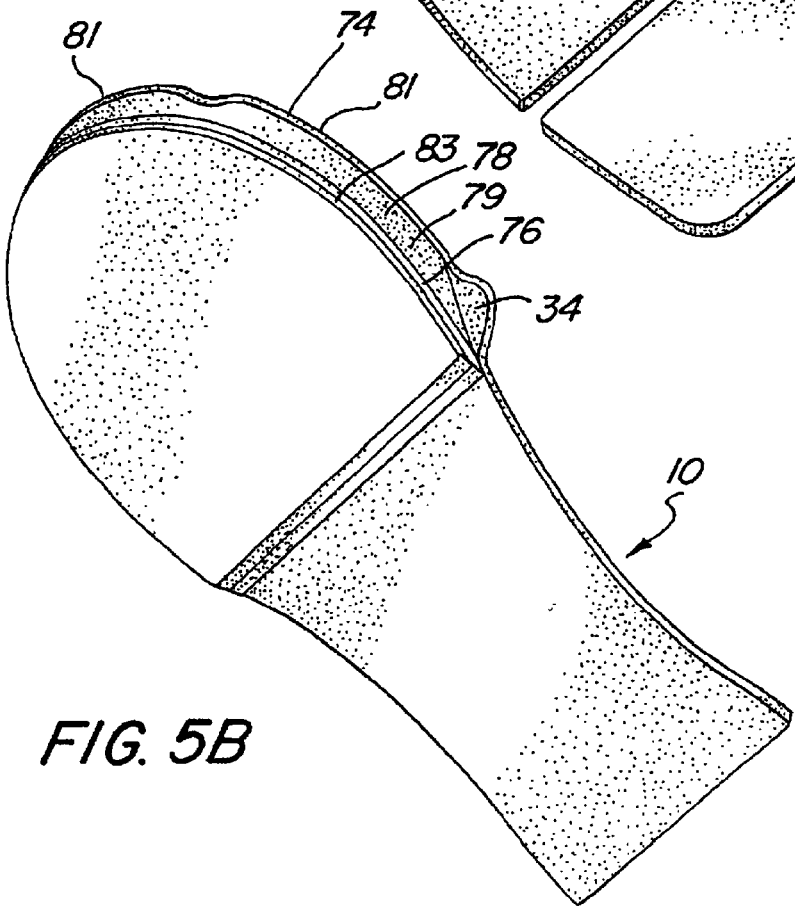
FIG. 5B

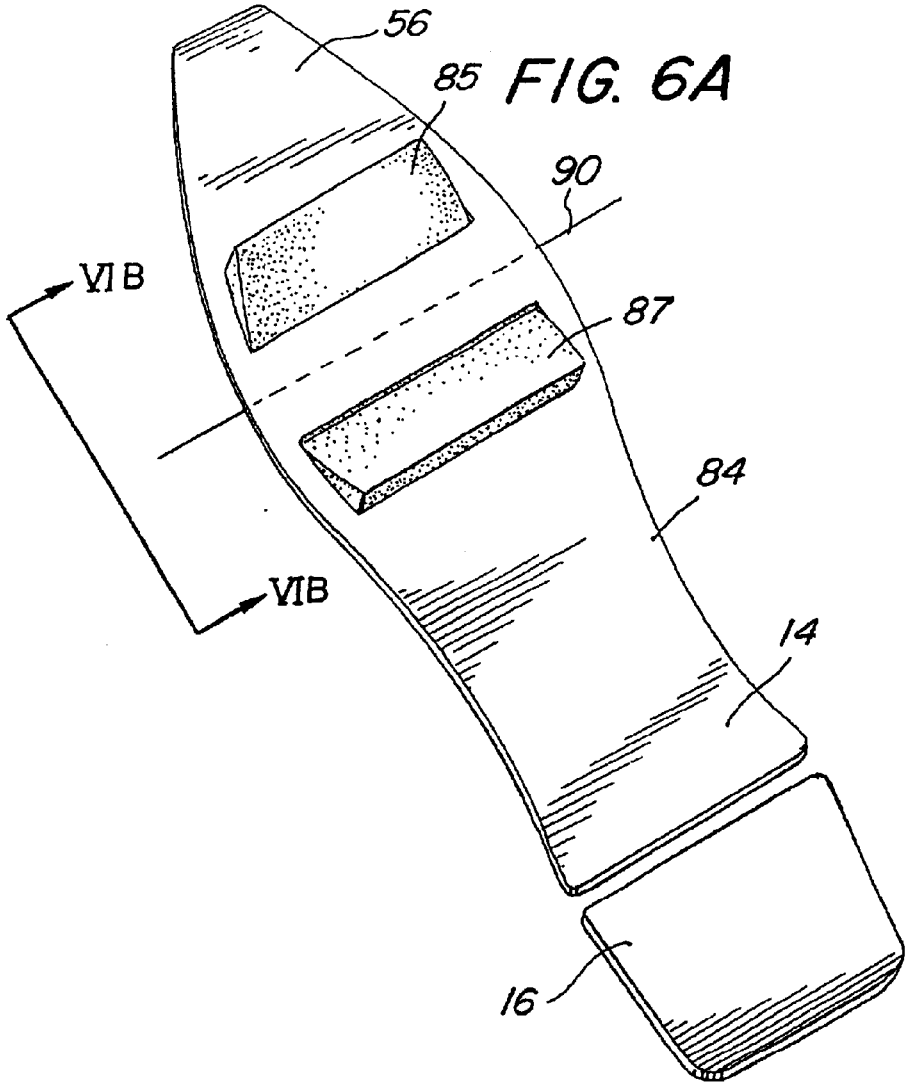
FIG. 6A
FIG. 6B
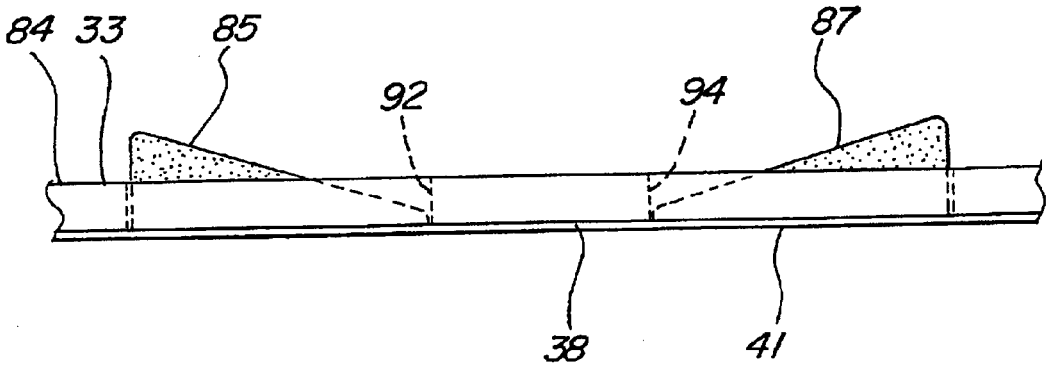

DRUM PEDAL FOR ENHANCED MATING OF A DRUMMER'S FOOT

BACKGROUND OF THE INVENTION

1. Field of the Invention

In general, this invention falls within the area of accessories for musical instruments and in particular, in the area of accessories for drums. There are many accessories for musical instruments and for drums to aid in drumming or in playing instruments. These accessories include accoutrements that make playing the instrument easier or that improve access to drumsticks. This invention has to do with drum pedals for bass drums and high hat or the like. A number of accessories or accoutrements that are associated with drum pedals are rather limited. Furthermore, there are probably few if any accessories that aid in finding the point of maximum delivery by sensory perception, as does the instant invention. Additionally, there are few if any accessories that are designed to reduce shock to a person's foot while playing a drum.

2. Description of the Prior Art

U.S. Pat. No. 4,819,536 to Lombardi discloses a drum pedal which is typical of the drum pedals used in the art. Lombardi has a heel pad 39 which has treads on an upper surface at 39*a*. Lombardi does not show a foot pad on the main portion of the pedal. U.S. Pat. No. 4,756,224 also to Lombardi similarly shows a foot pedal or drum with a heel pad that is treaded. U.S. Pat. Nos. 980,488; 902,444; 912,404; 1,570,167; 2,446,508; and 3,125,921 all show treaded coverings that are placed on drum pedals. These coverings are in most cases not pads but rather treads placed on the pedal to help the drummer keep his foot on the pedal. These treaded surfaces most often comprise a repeating pattern of ribs on the layer that is applied to an upper surface of the drum pedal. As shown in these references, the pattern of ribs covers the entire upper surface of the pedal. As such, there is really no distinguishing feature that aids a user in properly locating his or her foot on a drum pedal.

BRIEF SUMMARY OF THE INVENTION

The instant invention comprises a foot pad, which is generally in the shape of a human foot and thus is narrower in the arch region and broader in the areas corresponding to the ball and heal of the foot. This pad is placed on an upper surface of a drum pedal. The pad has a thickness from 1/16 inch to one inch, but could be of greater or lesser thickness. The material has to be relatively stiff to respond immediately to the force of the user's foot, and the thickness should not detract from the proper function or the mechanics of the pedal itself. The most important aspect of the pad is that it includes a protrusion or a rib that is located preferably in a ball portion of the foot pad to lie under the ball of the foot of the user. In this way, the pad enables the user to properly locate his or her foot on the drum pedal. To determine the proper positioning of the foot on the pedal while using the pad requires the user to learn the proper position during use. This is accomplished, for example, when the user repeatedly drums with the pedal and remembers a corresponding result when he or she applies a force to a particular location with respect to the protrusion or rib on the foot pad.

The foot pad of the instant invention may be accomplished by a relatively thin pad having an upper surface and a lower surface and that is shaped generally in the shape of a sole of a foot. The length of the pad is defined in the toe to heel direction, and a width is defined as being transverse to the toe to heel direction. The protrusion may be of any shape. However, in a preferred embodiment the protrusion is a rib extending across the width of the foot pad.

In addition to the protrusion or rib extending upwardly in the upper surface of the foot pad, the upper surface of the foot pad may also comprise traction structure for aiding and keeping the user's foot on the foot pad.

The foot pad may further comprise a plurality of layers. In a preferred embodiment the rib forming element is in an underlying layer. A protrusion or rib forming element in this embodiment forms a rib when an overlying layer is conformed around the protrusion or rib forming layer. In this way, the rib forming element provides a supporting element over which the overlying layer resides. The rib forming element may be of any configuration or shape. However, in the preferred embodiment the rib forming element has a tetrahedron section and is an elongate element which extends lengthwise across the width of the foot pad.

Expressed in another way, the foot pad of the instant invention may be described as follows. The overlying layer is a substrate and the underlying layer comprises a rib forming element. The foot pad has an outline generally in the shape of a sole. The foot pad is also provided with an adhesive layer for attachment to the drum pedal.

Because the overlying layer or substrate is of a flexible material the rib that is formed in an upper layer of the substrate is of a generally sinuous configuration. In the preferred embodiment this is achieved by the substrate being of an elastomeric foam material and the rib forming element also being of an elastomeric foam material. The substrate is adhesively attached to the rib forming element so that the substrate and the rib forming element apply a continuous resilient force on each other.

As indicated above, the foot pad has a ball portion in which the protrusion or rib is located. The foot pad also has an arch portion corresponding to a mating placement of the user's arch on the foot pad. A second protrusion or rib may be placed in the arch portion of the foot pad. The second protrusion or rib also aids in positioning the foot on the foot pad. An additional or third rib or protrusion may be placed on a heel portion of the foot pad. This third rib or protrusion helps in elevating the foot slightly during use.

In one embodiment the foot pad may include a third relatively stiff material layer. The third layer lies below the first and second layers and effectively extends the width of the foot pedal while supporting the first and second layers. Additionally this embodiment may include a built up portion around the peripheral edge of the foot pad. This built up portion preferably is provided by additional elements in the second layer.

The tetrahedron cross-section of the rib forming element may be more specifically described as a truncated triangular cross-section. The flexible and elastomeric nature of the foam material of the substrate and the rib forming element provides for or allows the substrate and the rib forming element to conform to each other when they are adhered to each other. In this way, a sinuous rib or a sinusoidally shaped surface is formed in an upper surface of the foot pad. At the same time, the rib forming element has rounded corners on the proximal edges of the truncated triangular section that engage an underside of the substrate; and a lower surface of the base of the truncated triangle forms a smile.

One of the principal purposes of the instant invention is to aid a user in locating his or her foot properly in the foot pedal. An alternative means for doing so is by providing a pair of ribs to be located on the foot pad above and below the ball portion. In this case the first and second ribs are in the form of wedges that slant downwardly and inwardly toward a center of the ball portion. Described in another way, the ball portion of the foot pad has a center, and the ribs extend upwardly and away from the center of the ball portion.

It should be noted that the foot pad may be provided as a single integral unit having a flexible region between the heel portion and the arch portion. This permits hinging motion of the pedal in an uninhibited manner to permit proper use of the foot pedal with the pad in place thereon. Alternatively, and preferably, the foot pad is provided in at least two separate pieces so that the heel piece is separate and detached from the rest of the foot pad which comprises an arch portion and a ball portion.

The method of using the foot pad of the instant invention includes affixing the foot pad to a drum pedal. In this step of the method of use, the user positions the foot pad such that the protrusion for rib is located in the ball portion of the drum pedal. In use, the user feels the protrusion with his or her foot during drumming with the pedal. The user experiences an optimal delivery of force to the foot pedal during drumming and thus learns the sweet spot on the drum pedal and particularly with respect to the protrusion or rib such that he or she may consistently apply the force to the sweet spot on the drum pedal with ease by the enhanced sensory perception that the foot pad and protrusion of the instant invention provides.

The instant invention also enables the user to vary his or her point of striking to selectively vary the force of the individual strokes on the drum pedal. As such, the instant invention enables greater consistency and enables the user to selectively vary the force of drumming. Also, by means of the compressible nature of the foot pad, the instant invention provides or enables greater endurance because of the lower impact on the user's foot.

In a broader sense, the instant invention comprises a method of drumming with a drum foot pedal that includes locating a protrusion on a ball portion of a drum pedal, then feeling the protrusion with a foot during drumming. Finally the method of drumming includes experiencing an optimal deliver of force in response to applying a drumming force at a particular location on the protrusion.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

BRIEF DESCRIPTION OF THE DRAWINGS

FIG. 5A is a fourth embodiment showing a built up portion around a periphery of a portion of the foot pad;

FIG. 5B is a bottom perspective view of the fourth embodiment shown in FIG. 5A;

FIG. 6A is a perspective view of a fifth embodiment; and

FIG. 6B is a side view of a portion of the foot pad of FIG. 6A taken along lines VIB.

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described below.

DETAILED DESCRIPTION OF THE PREFERRED EMBODIMENTS

Figure 1B:
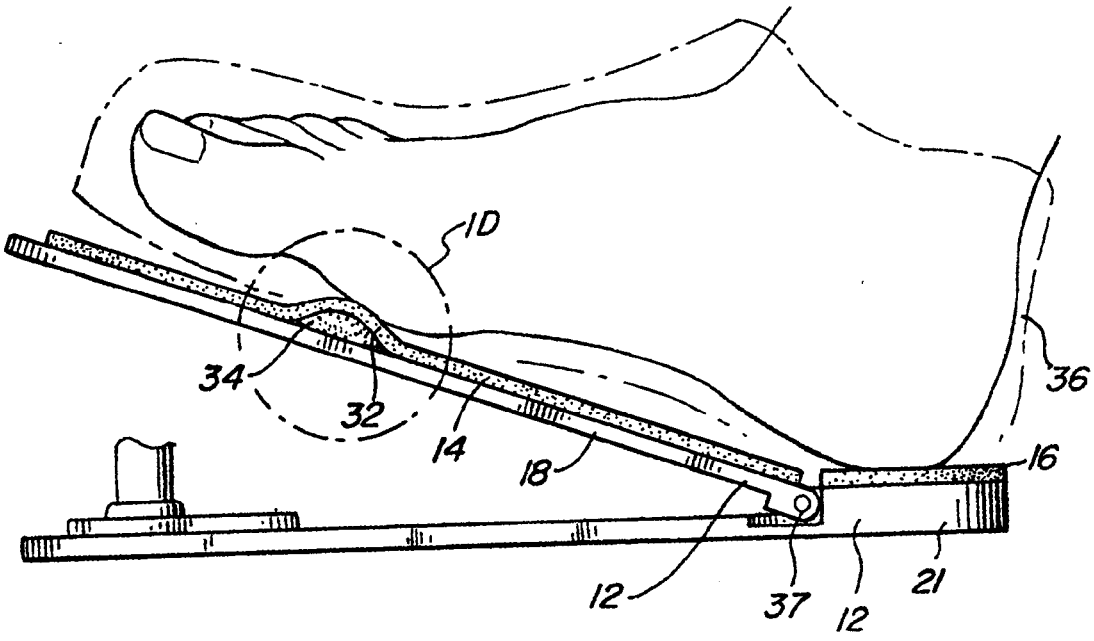
FIG. 1B is a side view of the drum pedal and pad of FIG. 1A.
Figure 1A:
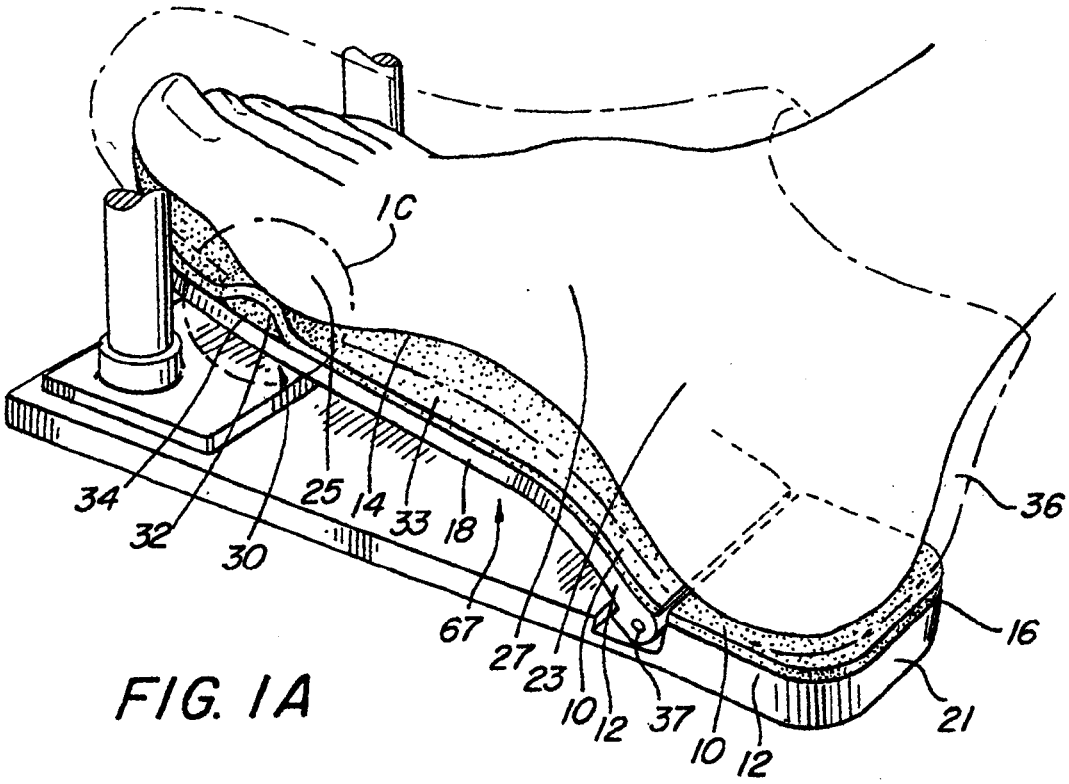
FIG. 1A is a perspective view of a drum pedal with the pad of the instant invention thereon and in use.

As shown in FIG. 1A, a drum pad 10 for a foot pedal 12 is illustrated. The foot pad has a main portion 14 and a heel portion 16 corresponding to a main portion 18 of the pedal and a heel portion 21 of the pedal, respectively.

In use a user's foot 23 is placed on the foot pad 10 as shown. A ball portion 25 and an arch portion 27 of the user's foot are matingly placed on the foot pad 10 as shown. A ball portion 30 of the foot pad 10 corresponding to the normal placement of ball portion 25 of a user's foot includes a protrusion or rib 32. The protrusion or rib 32 is provided in an upper surface 33 of the ball portion 30 of the foot pad. The protrusion 32 may be provided by a protrusion or rib forming element 34. Rib forming element 34 may be part of or added to the foot pad 14.

Figure 1C:
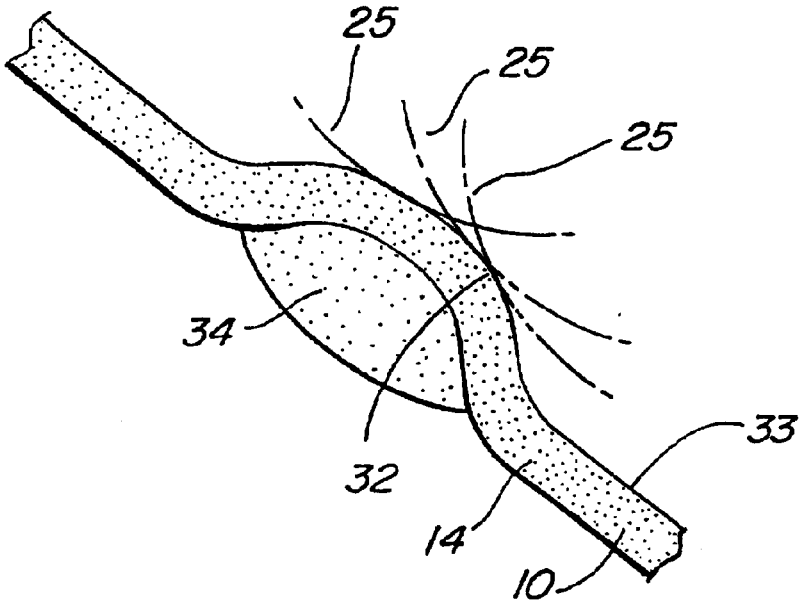
FIG. 1C is a detailed view of the encircled portion show at 1C in FIG. 1A.

As shown in FIGS. 1A and 1B the user may choose the use the instant invention in bare feet or wearing shoes or boots 36. As best shown in FIG. 1B the pedal 12 has a hinge 37. The main portion 14 and heel portion 16 of the foot pad may be separate or flexibly connected to each other. FIG. 1C shows the ball portion 25 of a user's foot contacting the protrusion or rib 32 in a variety of positions. This depicts how a user may selectively choose where to apply the force to the foot pad and drum pedal combination.

Figure 1D:
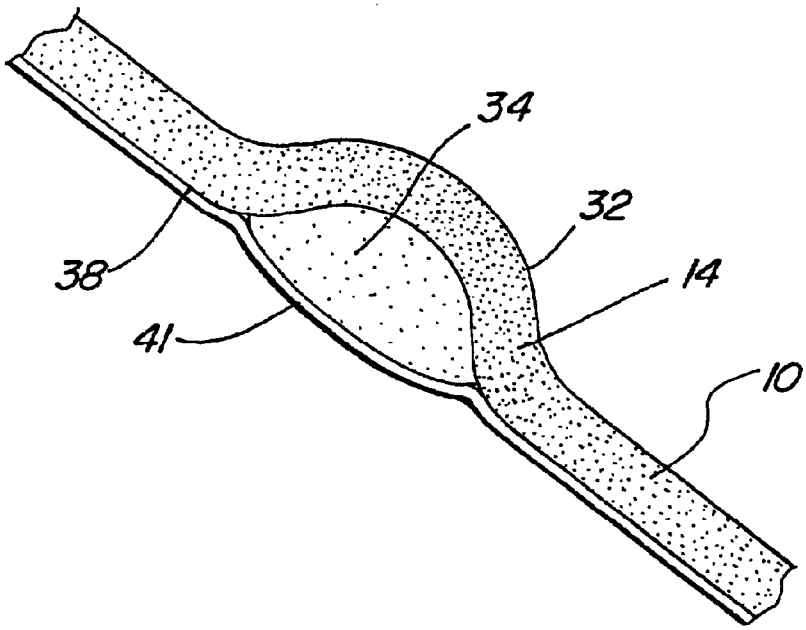
FIG. 1D is a further detailed view of the foot pad portion shown in FIG. 1C.

FIG. 1D illustrates the details of a means for attaching the foot pad 10 to the pedal 12. The means for attaching the foot pad 10 to the pedal 12 comprises an adhesive layer 38 and a backing material 41 for protecting the adhesive layer prior to affixing the foot pad 10 to the foot pedal 12.

Figure 2A:
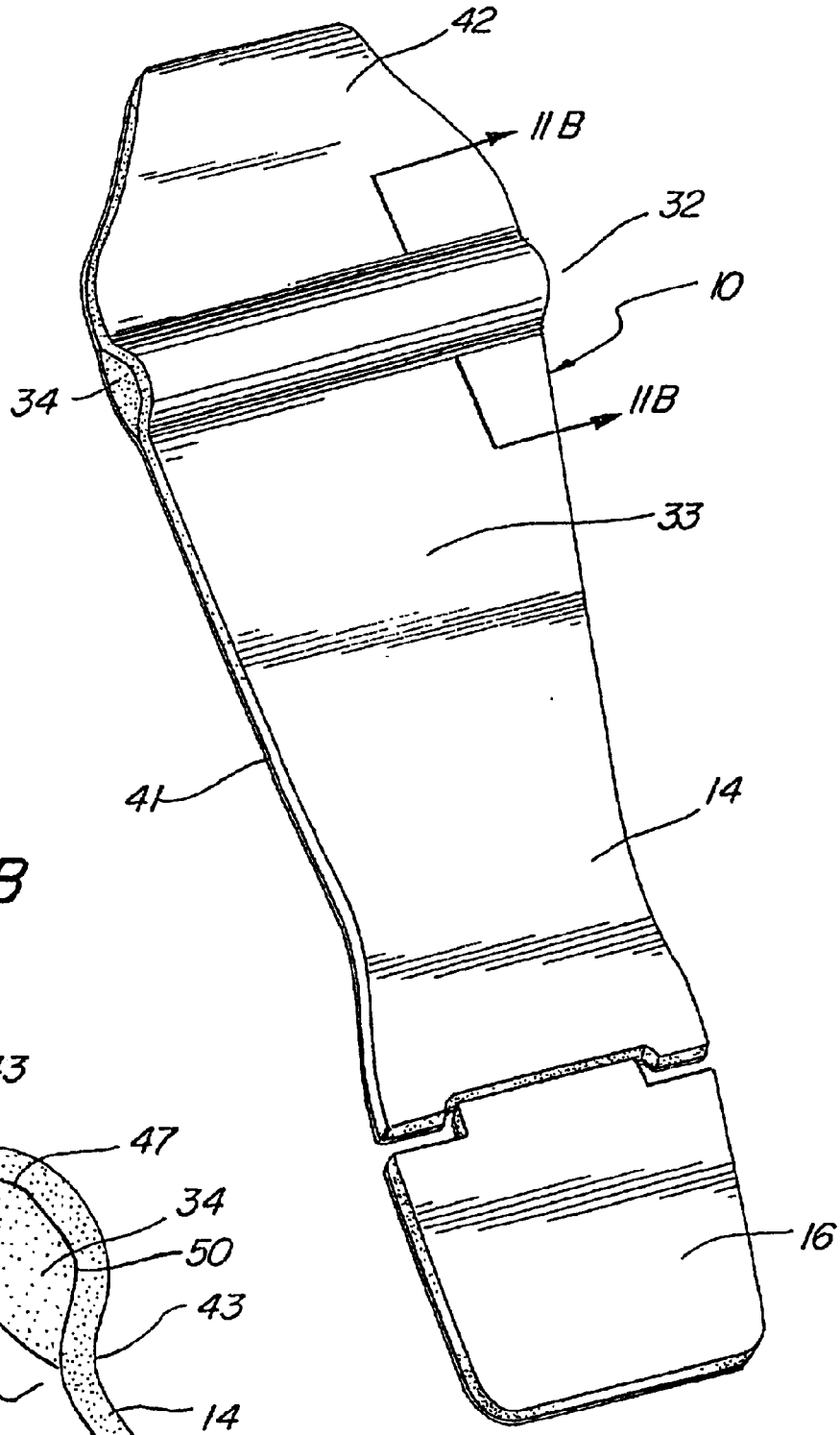
FIG. 2A is a perspective view of a first embodiment of the invention.

FIG. 2A shows a first embodiment of the foot pad 10 of FIGS. 1A–1B by itself. FIG. 2A completely illustrates the smooth rise and fall of the protrusion or rib 32 as it transitions from a relatively flat portion of the main portion of the pad 10 to the rib portion 32 and back to the relatively flat portion near the toe portion 42 of the pad 10.

Figure 2B:
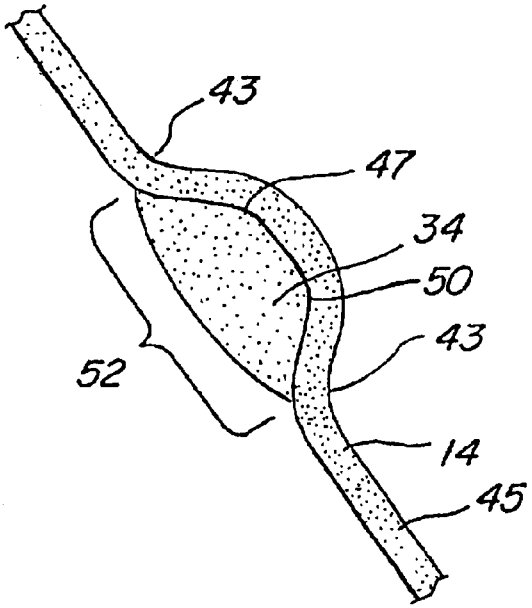
FIG. 2B is a detailed section view of a portion of FIG. 2A taken along lines IIB.

As best shown in FIG. 2B this transition may be described as a sinusoidal curve 43. Because of the flexible and compressible nature of the materials of the foot pad 10 and the rib or protrusion forming element 34, the normally tetrahedron section element 34 produces a smooth transition between flat portions of the foot pad and the protrusion or rib 32 in the upper surface 33 of the foot pad. This smooth transition is due to the reaction of an overlying layer or substrate 45 in response to being adhered to an underlying layer, or in this case, rib forming element 34. Because of the flexible and compressible nature of the rib forming element 34 the normally tetrahedron shape section is somewhat modified. This tetrahedron shape, which may be described as a truncated triangular section, has rounded corners at 47 and 50 corresponding to a truncated portion of the triangular shape of the section. Likewise, due to the flexible and resilient nature of the material of the overlying layer or substrate 45 a base portion of the truncated triangular section has a lower surface that forms a smile 52 when adhered to the overlying layer or substrate 45.

Figure 3:
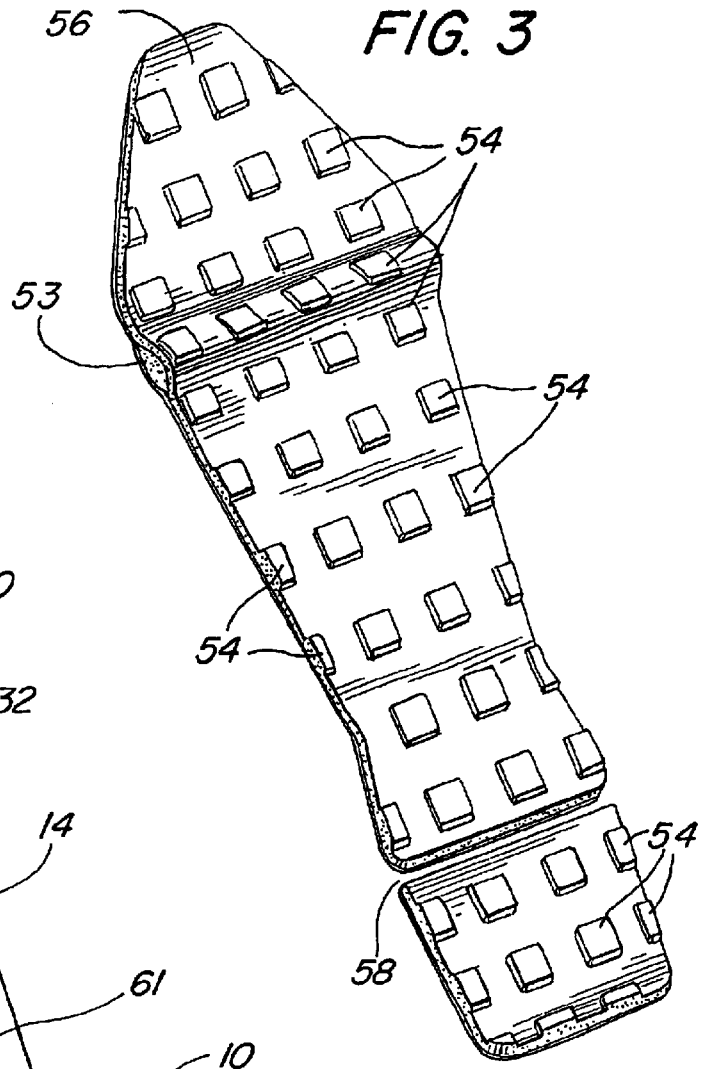
FIG. 3 is a second embodiment similar to the embodiment of FIG. 2A but having traction tread added.

FIG. 3 is a perspective view of a second embodiment similar to the embodiment of FIG. 2A. However, an overlying layer or substrate 53 has traction tread 54, toe structure 56 and a different heel connection 58. In all other aspects, the embodiment of FIG. 3 is substantially similar to the embodiment of FIGS. 2A and 2B.

Figure 4:
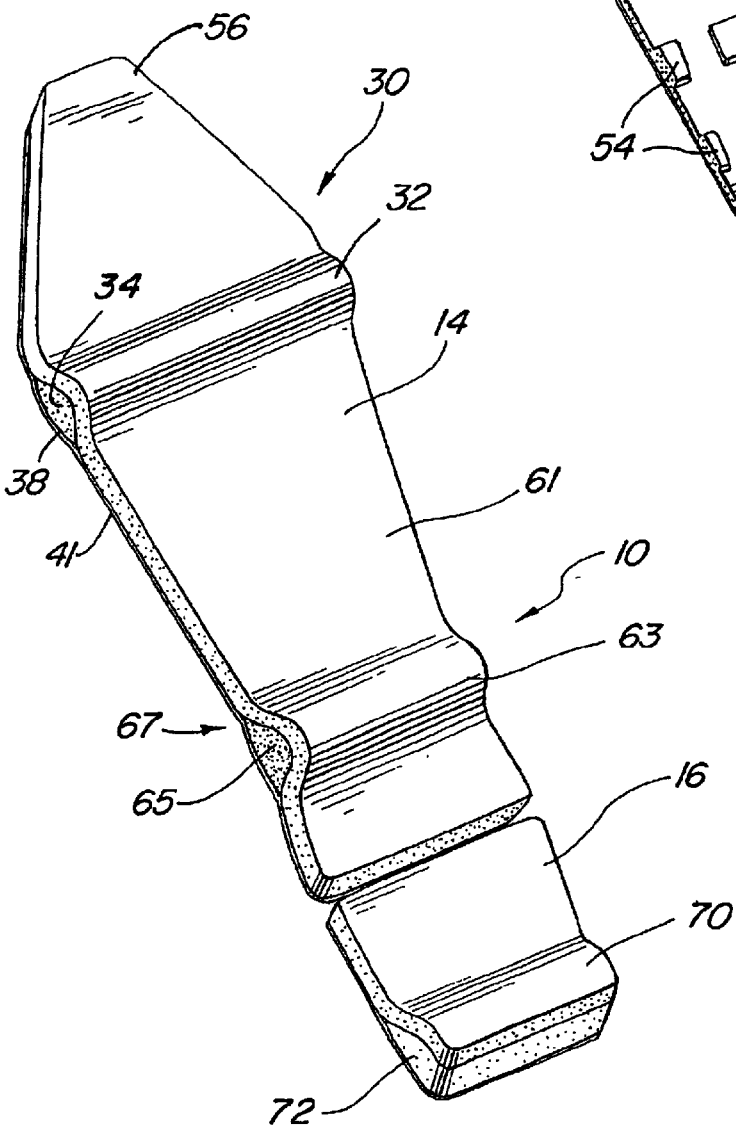
FIG. 4 is a third embodiment showing additional ribs in the arch portion and the heel portion.

FIG. 4 shows a third embodiment with an overlying layer or substrate 61 that is thicker than the embodiments of FIGS. 2A–3. A second protrusion or rib 63 is provided by a second rib providing element 65 in an arch portion 67 of the foot pad 10. This second protrusion or rib provides an added means for locating a user's foot by improved sensory perception in the arched portion 67 of the foot pad 10 and the pedal with which it is used. A third rib or protrusion 70 is provided in the heel portion 16 of the foot pad by a rib forming element 72. The third rib 70 has the additional function of raising the user's foot.

FIGS. 5A and 5B depict a fourth embodiment. This embodiment includes a thinner overlying layer 74 comprising traction treads 54. In addition to the overlying layer or substrate 74 and the rib forming element 34, the fourth embodiment includes a relatively stiff material forming an additional underlying layer 76. The stiff material 76 supports the more flexible material of the substrate 74 and the rib forming element 34 and effectively widens the foot pad 10 so that it extends wider than most standard foot pedals. This increases the surface area that can be engaged by the foot during drumming. At the same time, the flexible materials of substrate 74 and the protrusion or rib forming element 34 are supported by the stiffer material of the additional layer 76. The rib forming element 34 lays between the substrate 74 and the additional layer 76.

In this embodiment additional elements 78 are also positioned between the substrate 74 and the stiffer material layer 76 along a periphery of a portion of the foot pad 10. These additional elements 78 form a built up portion along a periphery of a portion of the foot pad 10. Built up portions 81 are shown in FIG. 5A. These built up portions further permit a user to properly locate his or her foot on the foot pad and pedal combination.

Additionally, built up portions 81 are effective for drummers that like to play on their toes. Many such players like to turn their foot to the side. In this way, the drummer's foot is transverse to the length of the pedal and pad, with the heal turned either outward or inward relative to its normal alignment with the body. For drummers that like to drum with their foot to the side, built up portions 81 provide a means for gripping the foot pad and pedal with their toes. It should also be noted that engaging the foot pad and pedal at the built up portion provides greater leverage. This is so, because the force is applied at a greater distance from the hinge 37. The built up portion 81 at the toe end of the pad acts as toe stop.

In this embodiment, the rib 32 at the ball portion may be omitted. In this case, the built up portions 81 remain and provide the at least one protrusion. As shown in FIG. 5A, the built up portions extend along a periphery of the foot pad from the toe to the ball portion of the foot pad 10. As such, the built up portions 81 are located at least partially in an intermediate portion of the foot pad 10.

An additional layer 83 may be provided subjacent to the additional stiff material layer 76. This additional layer 83 may be of a resilient compressible material to provide added cushioning and to further minimize impact on the user's foot.

Expressed in another way and as can be seen in FIGS. 5A and 5B, the fourth embodiment may comprise four layers including: (1) an overlying layer or substrate 74, (2) a next subjacent second layer 79 including protrusion or rib forming element 34 and additional elements 78, (3) a third layer and next subjacent layer provided by the stiffer material layer 76, and (4) a fourth layer 83 may comprise a resilient material for taking up some of the shock or impact to the user's foot.

As shown in FIGS. 6A and 6B, a fifth embodiment of the invention provides a means for locating a user's foot properly on a foot pad used in combination with a foot pedal of a drum. However, in this embodiment a substrate 84 is not an overlying layer and the means for properly positioning a user's foot on the foot pad comprises ribs 85 and 87. Ribs 85 and 87 are in the form of wedges that straddle a center line of a ball portion 30 of the foot pad. Edges 85 and 87 extend upwardly and away from center line 90 in opposite directions. In this embodiment the ribs or wedge members 85 and 87 are placed in recesses 92 and 94 in the substrate 83. Wedge members 85 and 87 protrude upwardly above an upper surface 33 of substrate 83. In this way a user may, by sensory perception, properly locate a ball of his or her foot in a ball portion of the foot pad. This embodiment, like all the others, has a means for adhering the foot pad to a foot pedal. A means for adhering the foot pad to the foot pedal comprises an adhesive layer 38 and a backing 41 as shown in FIG. 6B. While the materials for the construction of the instant invention may be selected from a large variety of materials without departing from the spirit and scope of the invention, it has been found that for the preferred embodiment, a polyurethane foam is preferable for overlying layers and rib forming elements, and that Mylar plastic is the preferred material for the underlying stiffer layer 76 of the fourth embodiment. The thickness of the overlying layer or substrate may be in the range from 1/16 of an inch to an inch. The thickness may be lesser or greater than this range but it must be kept in mind that the thickness of the overlying layer or substrate must not interfere with the proper functioning of the foot pedal.

While the materials used for the foot pad must be compressible and take up shock during drumming, they must also be relatively stiff to respond immediately to the force of the user's foot. To achieve a foot pad that accomplishes both of the requirements may be accomplished by selecting materials within the proper range of durometer. Durometer is a well known measure of the indentation hardness of materials ranging from cellular products to rigid plastics. The indentation hardness, of course is a function of the density, strength, and compressibility of the materials. In the instant invention the durometer is in the range of 20 to 90. However, it is contemplated that a foot pad of a material having a greater or lesser durometer than this may be employed. Although, specific materials have been set forth above, it is within the spirit and scope of this invention to provide the foot pedals of any materials. Specifically it is contemplated that the materials may include those that are absorbent in order to absorb sweat of a user during playing. Furthermore, the foam material may be of either the open cell or closed cell type.

Making the instant invention may be achieved in any number of ways including, but not limited to molding or die cutting the pad and its various elements. The preferred method of attaching the various layers in the embodiments incorporating layers, is by adhesive means. Attaching layers may be achieved by gluing or other adhesive means including heat fusion and sonic fusion. Although not preferred, even screwing or nailing the layers together is possible. Of course, an integral molding process may be incorporated to either eliminate the need for plural layers or to mold one or more layers around pre-existing elements or layers.

Also, it is contemplated that while the foot pad of the instant invention has been described and illustrated as having a generally sole shape it may have any number of shapes. In fact, the foot pads of the instant invention may be trimmed to properly fit any foot pedal of any drum or may be customized to fit a custom drum pedal. Furthermore, it should be noted that whether the foot pad is in two separate pieces or one integral piece having a flexible portion corresponding to the hinge region of the foot pedal of the drum, the concept still lies within the spirit and scope of the instant invention. The foot pad of the instant invention may comprise one piece, two pieces, or multiple pieces.

A method of using the instant invention is best depicted in FIGS. 1A and 1B. The method includes placing a foot pad 10 on a foot pedal 12 of a drum. Positioning of the foot pad 10 on the foot pedal 12 should be in a substantially matching or mating relationship to the foot pedal 12. A method of use further includes the step of the user feeling the protrusion or rib 32 with his or her foot 23 during drumming with the pedal 12. The user may thereby experience and remember an optimal delivery of force in response to applying a drumming force at a particular location on the protrusion or rib 32. In this way, a user may learn the sweet spot on the protrusion or rib 32.

By learning the sweet spot with the instant method provides for improved consistency. The pad 12 of the instant invention and use thereof improve endurance during drumming because of the lower shock to the foot 23 of the user. In use the user may vary the point at which he or she strikes or applied the force of individual strokes with the drum pedal. The protrusion or rib 32 of the instant invention facilitates selectively choosing a point at which the user may apply the force to thereby selectively vary the force of drumming and the force of the strokes for drumming.

Alternatively, for drummers that like to play on their toes, the foot pad may comprise built up portions 81 as shown in FIG. 5A. Such drummers sometimes turn their foot 23 to the side as indicated in dashed lines. In this configuration, the drummer can more easily grip the foot pad 10 and pedal via the built up portion 81. This method enables selectively drumming with more leverage since the drumming force is applied at a position further from the hinge of the pedal.

It is contemplated that the instant method includes, in its broadest sense, the method of drumming comprising the steps of locating a protrusion on a ball portion of a drum pedal, feeling the protrusion by the foot of the user during drumming with the pedal and experiencing an optimal delivery of force in response to applying a drumming force at a particular location on the protrusion.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

I claim:

1. A drum pedal comprising:

an upper surface;

a length in a toe to heal direction of said upper surface;

a width in a side to side direction of said upper surface;

and a sole protrusion protruding upwardly in said upper surface, wherein said protrusion aids in locating a foot on said pedal and in directing the forces of said foot on said pedal by enhanced sensory perception.

2. The drum pedal of claim 1 wherein said drum pedal further has traction structure extending upwardly on said upper surface.

3. The drum pedal of claim 1, said drum pedal further comprising a foot pad having a plurality of layers of a foam material.

4. The drum pedal of claim 3 wherein at least one of said layers is a protrusion forming element.

5. The drum pedal of claim 4 wherein said at least one layer is an underlying layer, said foot pad further comprising an overlying layer, which comprises said upper surface, so that said protrusion forming element supportingly forms a protrusion in said overlying layer.

6. The drum pedal of claim 1 wherein said protrusion is formed by a tetrahedron sectioned element that extends lengthwise across said width of said drum pedal.

7. A foot pad for a drum pedal having a generally flat substrate of flexible material having an outline generally in the shape of a sole, the foot pad being adapted for adhesive attachment to a drum pedal for reducing shock to a user's foot during drumming, said foot pad comprising: at least one protrusion; said protrusion extending generally upwardly from a remainder of an upper surface of said foot pad.

8. The foot pad of claim 7, wherein: said foot pad has a ball portion at a location corresponding to mating placement of a user's foot on said pad, and said protrusion is located at said ball portion of said foot pad.

9. The foot pad of claim 8, wherein: said foot pad has an arch portion corresponding to a mating placement of a user's arch on said foot pad, and said protrusion is a first protrusion, and said foot pad further comprises a second protrusion located at said arch.

10. The foot pad of claim 9, wherein: said foot pad has a heal portion corresponding to a mating placement of a user's heal on said foot pad, and said foot pad further comprises a third protrusion located at said heal portion.

11. The foot pad of claim 7, wherein: said substrate provides a first layer, and a second layer comprises a protrusion forming element forming said protrusion.

12. The foot pad of claim 11, wherein: said foot pad further comprises a third layer of relatively stiff material adjacent to said substrate; and said foot pad is wider than said pedal, and said stiff material supports said flexible material and acts to extend the width of said pedal.

13. The foot pad of claim 11, wherein said second layer further provides a built up portion along a periphery of said foot pad to help locate the foot by sensory perception.

14. The foot pad of claim 11, wherein: said protrusion is formed by said protrusion forming element; and said protrusion forming element underlies and forms a built up portion along a periphery of said foot pad to help locate the foot by sensory perception.

15. The foot pad of claim 7, wherein: said at least one protrusion is a first rib, said foot pad further comprising a second rib, and said first and second ribs are formed of respective wedge shaped members extending lengthwise across the width of the foot pad.

16. The foot pad of claim 15, wherein: said foot pad has a ball portion at a location corresponding to mating placement of a user's foot on said pad, and said ball portion has a center, and said wedge shaped members slant upward and away from said center of said ball portion.

17. The foot pad of claim 15, wherein said wedge shaped members have at least portions thereof recessed in said substrate.

18. The foot pad of claim 7, comprising: said substrate providing a first layer, an element providing a second underlying layer in a portion of said foot pad and forming said protrusion.

19. The foot pad of claim 18, wherein said protrusion comprises a continuous sinuous surface on an upper surface of said substrate.

20. The foot pad of claim 18, further comprising a third layer of adhesive material for sticking said foot pad to the pedal.

21. The foot pad of claim 18, wherein said element providing said second layer is an elongate member having a truncated triangular cross section such that said protrusion forms a rib.

22. The foot pad of claim 21, wherein said elongate member is flexible and is adhered to a lower surface of said substrate so that said rib is formed in an upper surface of said substrate and a surface of a base of said truncated triangular section forms a smile.

23. The foot pad of claim 7, wherein said foot pad is single integral unit having a flexible region between a heal portion and an arch portion for hinging motion during use of said pedal.

24. The foot pad of claim 7, wherein said foot pad comprises at least two separate pieces.

25. Method of using a foot pad for a drum pedal, said foot pad having a protrusion at least partially in an intermediate portion of said foot pad, the method comprising: affixing said foot pad on a drum pedal, positioning said foot pad such that said protrusion is located at least partially in said intermediate portion of a drum pedal, feeling the protrusion with the foot during drumming with the pedal experiencing an optimal delivery of force in response to applying a drumming force at a particular location of the protrusion; thereby learning a sweet spot on the protrusion for improved consistency and endurance during drumming.

26. The method of claim 25, further comprising the step of repeatedly striking the sweet spot on the foot pad.

27. The method of claim 26, further comprising varying a point of striking to selectively vary a force of individual strokes with said drum pedal.

28. Method of drumming with a drum foot pedal, the method comprising: locating a protrusion at least partially on an intermediate portion of a drum pedal feeling with the foot the protrusion during drumming with the pedal experiencing an optimal delivery of force in response to applying a drumming force at a particular location on said protrusion.

29. A foot pad for a drum pedal comprising a generally compressible material for reducing shock to a user's foot during drumming, the foot pad being adapted for attachment to a drum pedal, said foot pad comprising: at least one protrusion for locating at least partially in an intermediate portion of said pedal; said protrusion having a smooth continuous surface for contact with the user's foot to reduce localized pressure to said foot; wherein, said user, feels said protrusion with said foot during drumming with the pedal and experiences an optimal delivery of force in response to applying a drumming force at a particular location on said protrusion, and thereby learns a sweet spot on the protrusion for improved consistency and endurance during drumming.

* * * * *